US005263474A

United States Patent [19]

Agader

[11] Patent Number: 5,263,474

[45] Date of Patent: Nov. 23, 1993

[54] FOOT MASSAGING DEVICE

[76] Inventor: Jeffrey Agader, 94-366 Makalu Loop, Mililani, Hi. 96789

[21] Appl. No.: 893,013

[22] Filed: Jun. 3, 1992

[51] Int. Cl.[5] ..... A61H 15/00

[52] U.S. Cl. ..... 128/57; 128/25 B

[58] Field of Search ..... 128/25 B, 57, 24.3, 128/60, 61, 67

[56] References Cited

U.S. PATENT DOCUMENTS

| | | | |
|---|---|---|---|
| 3,994,290 | 11/1976 | Springer | 128/57 |
| 4,010,743 | 3/1977 | Fitzsimmons | 128/25 B |
| 4,113,246 | 9/1978 | Gibbs | 128/57 |
| 4,169,466 | 10/1979 | Wong | 128/57 |

FOREIGN PATENT DOCUMENTS

| | | | |
|---|---|---|---|
| 3902236 | 8/1990 | Fed. Rep. of Germany | 128/25 B |

*Primary Examiner*—Robert A. Hafer
*Assistant Examiner*—David J. Kenealy
*Attorney, Agent, or Firm*—Michael I. Kroll

[57] ABSTRACT

An improved foot massaging device is provided which consists of a rigid unitary frame member being of a size and strength to support the feet and weight of a person standing thereon. A mechanism is within the frame member for effectively simulating a finger point pressing and kneading action against the underside of the feet.

12 Claims, 2 Drawing Sheets

FOOT MASSAGING DEVICE

BACKGROUND OF THE INVENTION

1. Field of the Invention

The instant invention relates generally to massage apparatuses and more specifically it relates to an improved foot massaging device.

2. Description of the Prior Art

Numerous massage apparatuses have been provided in prior art that are adapted to rub and knead various parts of a person's body to aid in circulation of the blood and to relax the muscles. While these units may be suitable for the particular purpose to which they address, they would not be as suitable for the purposes of the present invention as heretofore described.

SUMMARY OF THE INVENTION

A primary object of the present invention is to provide an improved foot massaging device that will overcome the shortcomings of the prior art devices.

Another object is to provide an improved foot massaging device that includes a mechanism for effectively simulating finger point pressing and kneading action to the foot.

An additional object is to provide an improved foot massaging device in which the mechanism produces a limited multidirectional rolling action for effectively simulating the finger point pressing and kneading action to the foot.

A further object is to provide an improved foot massaging device that is simple and easy to use.

A still further object is to provide an improved foot massaging device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
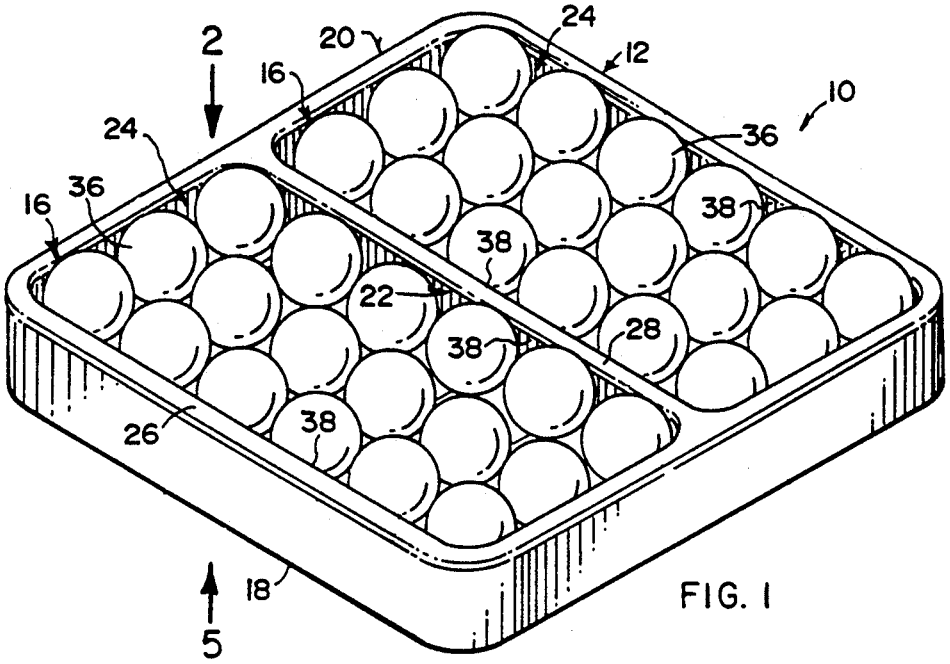
FIG. 1 is a perspective view of the instant invention.
Figure 2:
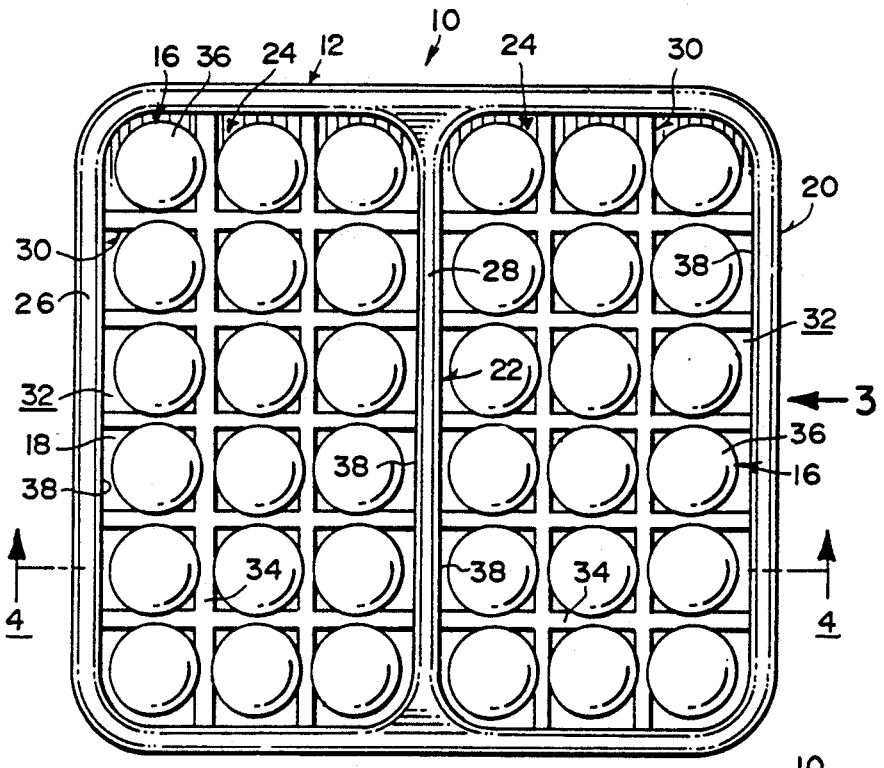
FIG. 2 is a top view taken in direction of arrow 2 in FIG. 1.
Figure 3:
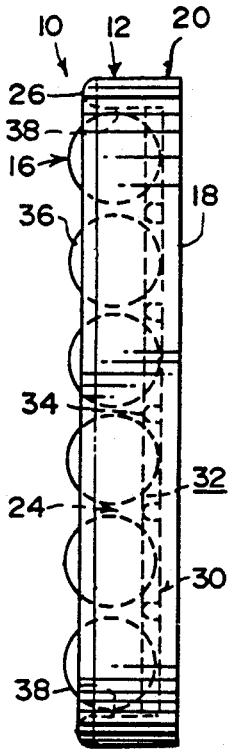
FIG. 3 is a side view taken in direction of arrow 3 in FIG. 2.
Figure 4:
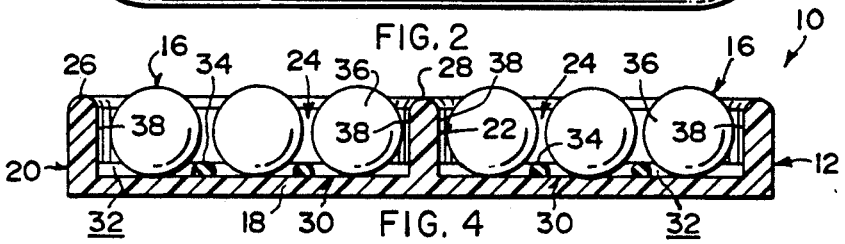
FIG. 4 is a cross sectional view taken along line 4—4 in FIG. 2.
Figure 5:
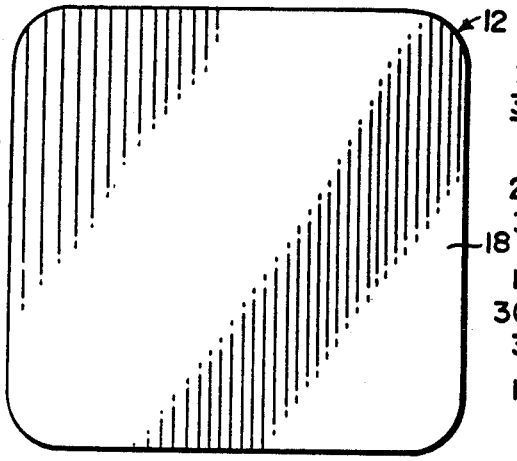
FIG. 5 is a bottom view taken in direction of arrow 5 in FIG. 1.

Turning now descriptively to the drawings, in which similar reference characters denote similar elements throughout the several views, the Figures illustrate an improved foot massaging device 10, which consists of a rigid unitary frame member 12, being of a size and strength to support the feet 14 and weight of a person standing thereon. A mechanism 16 is within the frame member 12 for effectively simulating a finger point pressing and kneading action against the underside of the feet 14.

The frame member 12 includes a base portion 18 to sit upon a flat horizontal surface. An upstanding side wall portion 20, extends about the perimeter of the base portion 18. An upstanding center wall portion 22 extends from the base portion 18 to divide the frame member 12 into two equally sized open top compartments 24.

Figure 9:
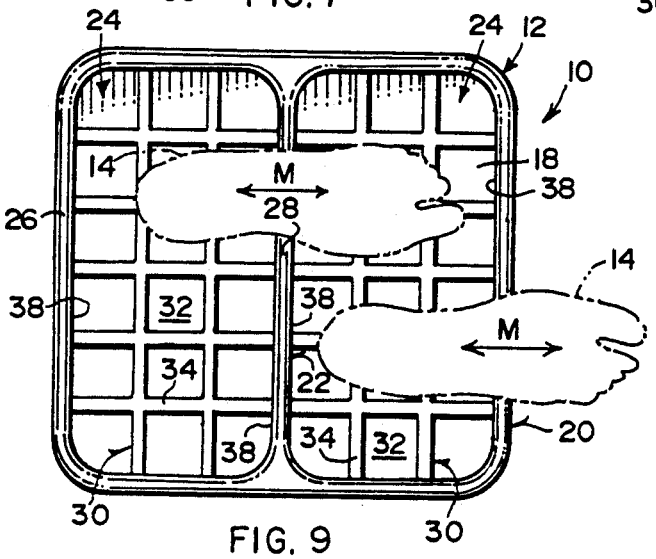
FIG. 9 is a top view as in FIG. 6, showing the feet in engagement with the center wall and the side wall.

A top edge 26 of the side wall portion 20 and a top edge 28 of the center wall portion 22 are rounded and of the same height, so that the feet 14 can be placed onto the top edge 26, 28 of the side wall portion 20 and the center wall portion 22 to simulate a massage using the edges of a palm of a hand when a desired downward pressure is applied from a standing position. (See FIG. 9.)

The improved foot massaging device 10 further includes a pair of grid members 30 having a plurality of square retainer areas 32, with each said grid member 30 located within one of the open top compartments 24 on the base portion 18. A top edge 34 of each grid member 30 is rounded and lower in height than the side wall portion 20 and the center wall portion 22.

The simulating mechanism 16 includes a plurality of spherical balls 36, each sized to fit into each square retainer area 32 in the grid members 30. The spherical balls 36 will roll freely within the square retainer areas 32 and just extend above the height of the side wall portion 20 and the center wall portion 22. The square retainer areas 32 and the interior surface 38 of the side wall portion 20 and the center wall portion 22 in each open top compartment 24, will limit the roll of the spherical balls 36 for effectively simulating the finger point pressing and kneading action against the underside of the feet 14.

Figure 10:
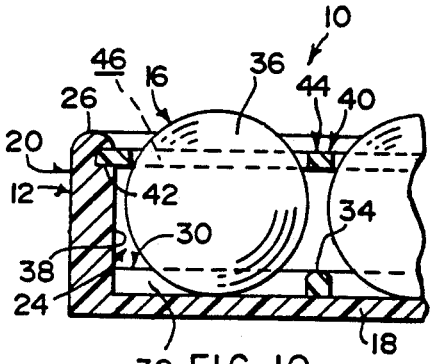
FIG. 10 is a cross sectional view of a portion of a modification, showing a snap-in upper grid to hold the spherical balls in position.

FIG. 10 shows a mechanism 40 for holding the spherical balls 36 in position within the square retainer areas 32 in the grid members 30, so that the device 10 can be transported from one location to another.

The holding mechanism 40 includes each open top compartment 24 having a groove 42 in the interior surface 38, adjacent the top edge 26, 28 of the side wall portion 20 and the center wall portion 22. A pair of upper grid members 44 are provided having a plurality of upper square retainer areas 46. Each upper grid member 44 can snap into each groove 42 to retain the spherical balls 36 in a rotatable relationship within each open top compartment 24.

The rigid unitary frame ember 12, each grid member 30, each spherical ball 36, each upper grid member 44 are all fabricated out of a durable strong material, such as plastic, wood, rubber, metal, laminated fibrous material and the like.

Figure 6:
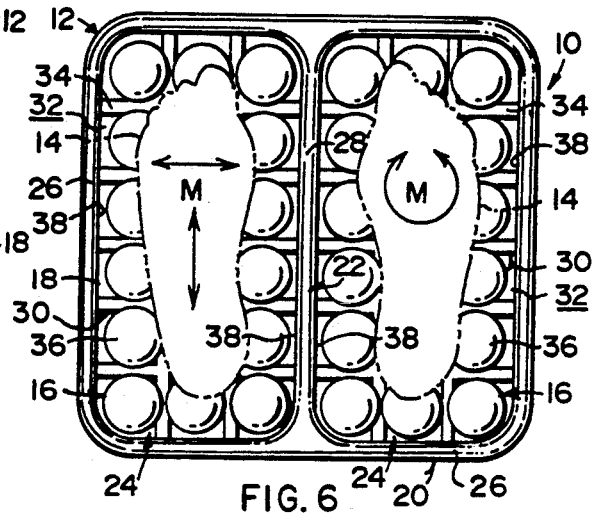
FIG. 6 is a top view, as in FIG. 2, showing the placement of the feet thereon.
Figure 7:
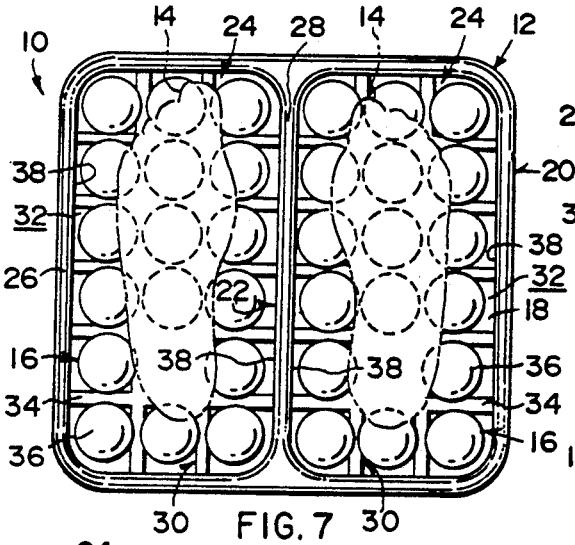
FIGS. 7 and 8 are top views, as in FIG. 6, showing alternate arrangement position of the spherical balls with the placement of the feet thereon.
Figure 8:
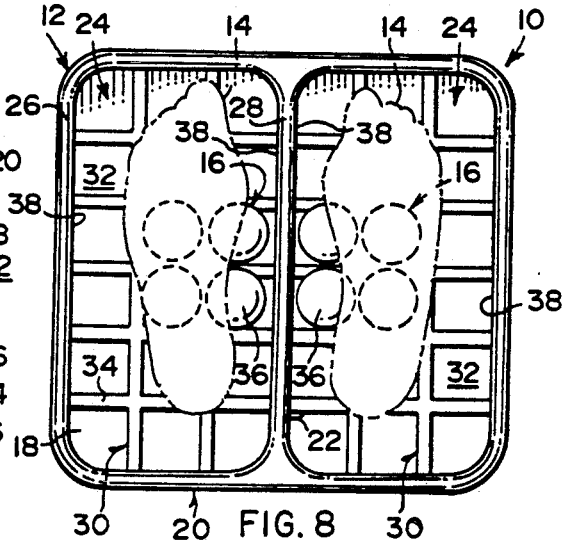

The dimensions which are typical but not limited in size for the various parts of the improved foot massaging device are as follows. The height of the base portion 18 is two centimeters. Each open top compartment 24 is roughly fifteen centimeters by thirty centimeters (rectangular in shape). The height of each grid member 30 is approximately one centimeter. The height and width of the side wall portion 20 and the center wall portion 22 is approximately three centimeters and one and a half centimeters respectively. The spherical balls 36 are roughly four and a half centimeters in diameter, and can be arranged in different rows and columns on the grid members 30 to form different patterns for the feet 14 (see FIGS. 6, 7 and 8). The groove 42 and the height of each upper grid member 44 is also approximately one centimeter.

LIST OF REFERENCE NUMBERS 10 improved foot massaging device
12 frame member
14 foot
16 simulating mechanism
18 base portion
20 side wall portion
22 center wall portion
24 open top compartment
26 top edge of 20
28 top edge of 22
30 grid member
32 square
34 top edge of 30
36 spherical ball
38 interior surface of 20 and 22
40 holding mechanism
42 groove in 38
44 upper grid member
46 upper square retainer area It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved foot massaging device which comprises:

a) first means for effectively simulating a finger point pressing and kneading action against the underside of the feet, said first means being balls, said balls being positioned on a hard base void of all liquid so that the roll of said balls will effectively simulate said finger point kneading action because the roll of said balls would be limited, since said balls have a limited roll the improved foot massaging device is easier to use;

b) a rigid unitary frame member being of a size and strength to support the feet and weight of a person standing thereon, said rigid unitary frame member having a center and side walls extending generally perpendicular from said hard base, the center and side walls are continuous and intersecting defining two open halves of the rigid unitary frame member; and c) second means disposed in both halves of said rigid unitary frame member, said second means being a square grid, said square grid comprised essetially of continous wall sections that intersect each other forming square openings and allowing said balls to be moved from one part of the grid to another to alter the pattern and massage action and focus on specific areas of said feet, said rigid unitary frame member having a center and side walls which can be used to massage said feet, the size of the square grid members enable said balls to rotate from multiple positions to better simulate said finger point kneading action.

2. An improved foot massaging device as recited in claim 1, wherein said frame member includes:

a) a base portion to sit upon a flat horizontal surface
b) an upstanding side wall portion extending about the perimeter of said base portion; and
c) an upstanding center wall portion extending from said base portion to divide said frame member into two equally sized open top compartments.

3. An improved foot massaging device as recited in claim 2, wherein a top edge of said side wall portion and a top edge of said center wall portion are rounded and of the same height, so that the feet can be placed onto said top edge of said side wall portion and said center wall portion, to simulate a massage using the edges of a palm of a hand when a desired downward pressure is applied from a standing position.

4. An improved foot massaging device as recited in claim 3, further including a pair of grid members having a plurality of square retainer areas, with each said grid member located within one of said open top compartments on said base portion.

5. An improved foot massaging device as recited in claim 4, wherein a top edge of each said grid member is rounded and lower in height than said side wall portion and said center wall portion.

6. An improved foot massaging device as recited in claim 5, wherein said simulating means includes a plurality of spherical balls, each sized to fit into each said square retainer area in said grid members, so that said spherical balls will roll freely within said square retainer areas and just extend above the height of said side wall portion and said center wall portion, so that said square retainer area and the interior surface of said side wall portion and said center wall portion in each said open top compartment, will limit the roll of said spherical balls for effectively simulating the finger point pressing and kneading action against the underside of the feet.

7. An improved foot massaging device as recited in claim 6, further including means for holding said spherical balls in position within said square retainer areas in said grid members, so that said device can be transported from one location to another.

8. An improved foot massaging device as recited in claim 7, wherein said holding means includes:

a) each said open top compartment having an groove in said interior surface adjacent said top edge of said side wall portion and said center wall portion; and b) a pair of upper grid members having a plurality of upper square retainer areas, so that each said upper grid member can snap into each said groove to retain said spherical balls in a rotatable relationship within each said open top compartment.

9. An improved foot massaging device as recited in claim 8, wherein said rigid unitary frame member is fabricated out of a durable strong material.

10. An improved foot massaging device as recited in claim 9, where each said grid member is fabricated out of a durable strong material.

11. An improved foot massaging device as recited in claim 10, wherein each said spherical ball is fabricated out of a durable strong material.

12. An improved foot massaging device as recited in claim 11, wherein each said upper grid member is fabricated out of a durable strong material.

* * * * *